US011253078B2

(12) United States Patent
Whiteside et al.

(10) Patent No.: US 11,253,078 B2
(45) Date of Patent: Feb. 22, 2022

(54) MOBILE CHAIR

(71) Applicant: Whiteside Mfg. Co., Delaware, OH (US)

(72) Inventors: Kirt E. Whiteside, Marion, OH (US); Robert J. Reitmire, Marion, OH (US)

(73) Assignee: WHITESIDE MFG. CO, Delaware, OH (US)

( * ) Notice: Subject to any disclaimer, the term of this patent is extended or adjusted under 35 U.S.C. 154(b) by 4 days.

(21) Appl. No.: 16/451,195

(22) Filed: Jun. 25, 2019

(65) Prior Publication Data

US 2020/0037770 A1 Feb. 6, 2020

Related U.S. Application Data

(60) Provisional application No. 62/713,671, filed on Aug. 2, 2018.

(51) Int. Cl.

| | |
|---|---|
| ***A47C 9/02*** | (2006.01) |
| ***A47C 7/00*** | (2006.01) |
| ***A47C 5/04*** | (2006.01) |

(52) U.S. Cl.

CPC ..... *A47C 9/02* (2013.01); *A47C 5/04* (2013.01); *A47C 7/006* (2013.01)

(58) Field of Classification Search

CPC ..... A47C 9/02; A47C 5/04; A47C 7/006

See application file for complete search history.

(56) References Cited

U.S. PATENT DOCUMENTS

| | | | | | |
|---|---|---|---|---|---|
| 2,465,104 | A | * | 3/1949 | Kullack | A47D 1/004 297/338 X |
| 2,995,182 | A | * | 8/1961 | Hendrickson | A47C 3/021 297/451.3 X |
| 3,976,155 | A | * | 8/1976 | Esch | E04F 21/22 280/32.5 |
| RE36,335 | E | * | 10/1999 | Perry | A47C 1/032 297/239 X |
| D436,748 | S | * | 1/2001 | Noll | D6/360 |
| 6,929,275 | B1 | * | 8/2005 | Schlangen | A47C 5/04 280/250.1 |
| D871,091 | S | * | 12/2019 | Whiteside | D6/360 X |

FOREIGN PATENT DOCUMENTS

| | | | | |
|---|---|---|---|---|
| DE | 3700321 | A1 * | 7/1988 | A47C 4/02 |

* cited by examiner

*Primary Examiner* — Anthony D Barfield

(74) *Attorney, Agent, or Firm* — Renner, Kenner, Greive, Bobak, Taylor & Weber

(57) ABSTRACT

A chair includes a unitary tubular main frame having spaced base portions and spaced side supports. A seat frame is carried by the main frame and the space below the seat frame and between the base portions and the side supports is unobstructed. A tray is carried by the base portions at the back of the chair so as to maintain the front of the chair unobstructed.

14 Claims, 2 Drawing Sheets

MOBILE CHAIR

CROSS-REFERENCE TO RELATED APPLICATION

This application claims the benefit of U.S. Provisional Application No. 62/713,671 filed Aug. 2, 2018, the contents of which are incorporated herein by reference.

TECHNICAL FIELD

This invention relates to a mobile seat or chair. More particularly, this invention relates to such a seat which is especially adapted for use by a mechanic.

BACKGROUND ART

Mobile chairs for use by mechanics or the like when servicing vehicles are known in the art. Such chairs must be sturdily constructed to withstand the rigors of their use. As such, these chairs typically have a variety of both vertically and horizontally oriented support framework, both of which can detract from the comfort of the user. In addition, most such chairs are also provided with trays or storage features which also often tend to get in the way of the user.

Thus, the need exists for a mobile chair which is sturdy and which provides storage space without the sacrifice of comfort for the user.

SUMMARY OF THE INVENTION

It is thus an object of one aspect of the present invention to provide a mobile chair which is sturdy but which has no frame members which might be in the way of the user.

It is an object of an additional aspect of the present invention to provide a mobile chair, as above, which is formed of a unitary tubular frame configured so as to provide strength to the chair.

It is an object of a further aspect of the invention to provide a mobile chair, as above, with a storage tray which is not in the way of the user.

These and other objects of the present invention, as well as the advantages thereof over existing prior art forms, which will become apparent from the description to follow, are accomplished by the improvements hereinafter described and claimed.

In general, a chair made in accordance with the present invention includes a main frame and a seat frame attached to the main frame. The main frame has spaced sides with no portion of the main frame being located between the sides and below the seat frame.

In accordance with another aspect of the present invention, a chair includes a unitary tubular frame having ends located near the back of the chair. The frame has spaced sides extending from the ends toward the front of the chair with the space between the sides at the front of the chair being unobstructed. A seat frame is attached to the tubular frame above the unobstructed space.

In accordance with yet another aspect of the invention, a chair includes a unitary tubular frame having ends located near the back of the chair. The frame has spaced base portions extending from the ends toward the front of the chair with the space between the base portions at the front of the chair being unobstructed. A tray is carried between the base portions near the ends of the frame. The tray extends partially toward the front of the chair so as to maintain the space between the base portions at the front of the chair unobstructed.

A preferred exemplary mobile chair according to the concepts of the present invention is shown by way of example in the accompanying drawings without attempting to show all the various forms and modifications in which the invention might be embodied, the invention being measured by the appended claims and not by the details of the specification.

PREFERRED EMBODIMENT FOR CARRYING OUT THE INVENTION

Figure 1:
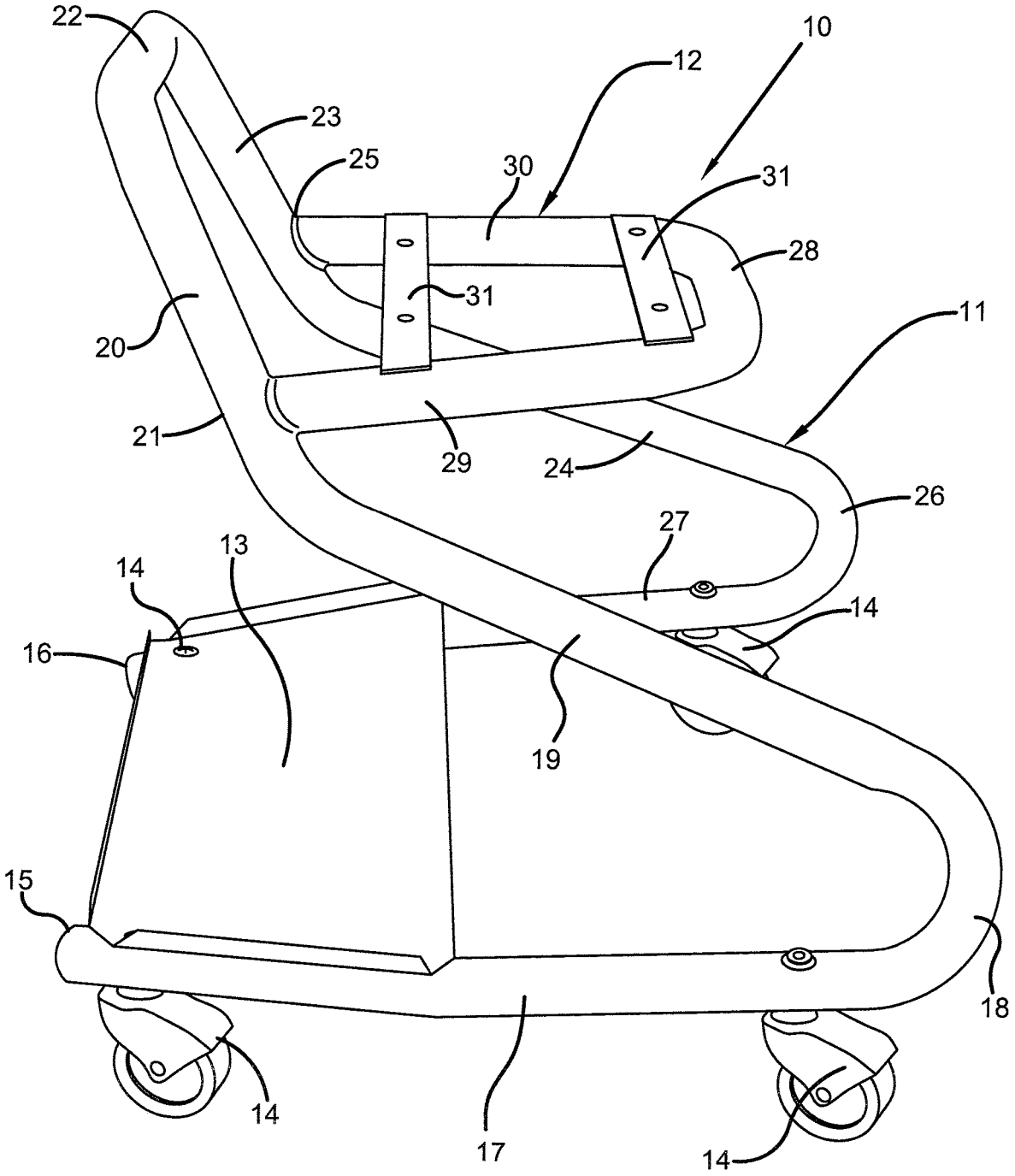
FIG. 1 is a side perspective view of a mobile chair made in accordance with the present invention.

A mobile chair made in accordance with the present invention is indicated generally by the numeral 10 and includes a main frame indicated generally by the numeral 11, a seat frame indicated generally by the numeral 12, a tray 13 for holding materials, and a plurality of caster assemblies 14.

Main frame 11 is made up of a continuous unitary tubing having a first end 15 and a second end 16 both located at the rear of chair 10. The tubing has a generally horizontal base portion 17 which extends forwardly from first end 15 to a strength bend 18 at the front of chair 10 and then turns diagonally upwardly as a side support 19. Side support 19 merges into a back support tubing 20, as at 21, with tubing 20 extending diagonally upwardly at a different angle than that of side support 19. Back support tubing 20 terminates upwardly as a generally horizontal portion 22 of the back support which, in turn, terminates as a downwardly diagonally extending second back support tubing 23 which opposes back support tubing 20. Together, tubing 20, portion 22, and tubing 23 form the back support for chair 10.

Second back support tubing 23 merges into a second side support 24, as at 25. Second side support 24 extends diagonally downwardly at a different angle than second back support tubing 23 and is opposed to, and parallels, side support 19. Second side support 24 terminates at the front of chair 10 as a second strength bend 26 which is identical to opposed bend 18. The main frame 11 then terminates as a second generally horizontal base portion 27 which is opposed to horizontal portion 17 and which extends rearwardly from second strength bend 26 to the second end 16 of the tubing.

Horizontal base portions 17 and 27 of main frame 11 carry the conventional caster assemblies 14. Specifically, a caster assembly 14 is mounted on base portions 17 and 27 near each end 15 and 16, and a caster assembly 14 is mounted near each of the opposed ends of base portions 17 and 27.

Conventional mobile chairs would typically be provided with one or more cross beams extending between the side horizontal portions 17 and 27 near the fronts thereof. However, the strength bends 18 and 26 eliminate the need for any such cross beams, and thus the front of chair 10 under seat frame 12 is open between frame portions 17, and 27 and between side supports 19 and 24. Thus, there is no obstruction to the feet of the user of chair 10.

Similarly, many conventional mobile chairs have a tray or drawer which obstructs the front area of the chair. In the present invention, tray 13 can be carried between horizontal frame portions 17 and 27 near the ends 15 and 16 thereof. As such, chair 10 can be provided with a storage area for tools or the like of the user while leaving the front of the chair 10 between frame base portions 17 and 27 and between side supports 19 and 24 open and unobstructed.

Figure 2:
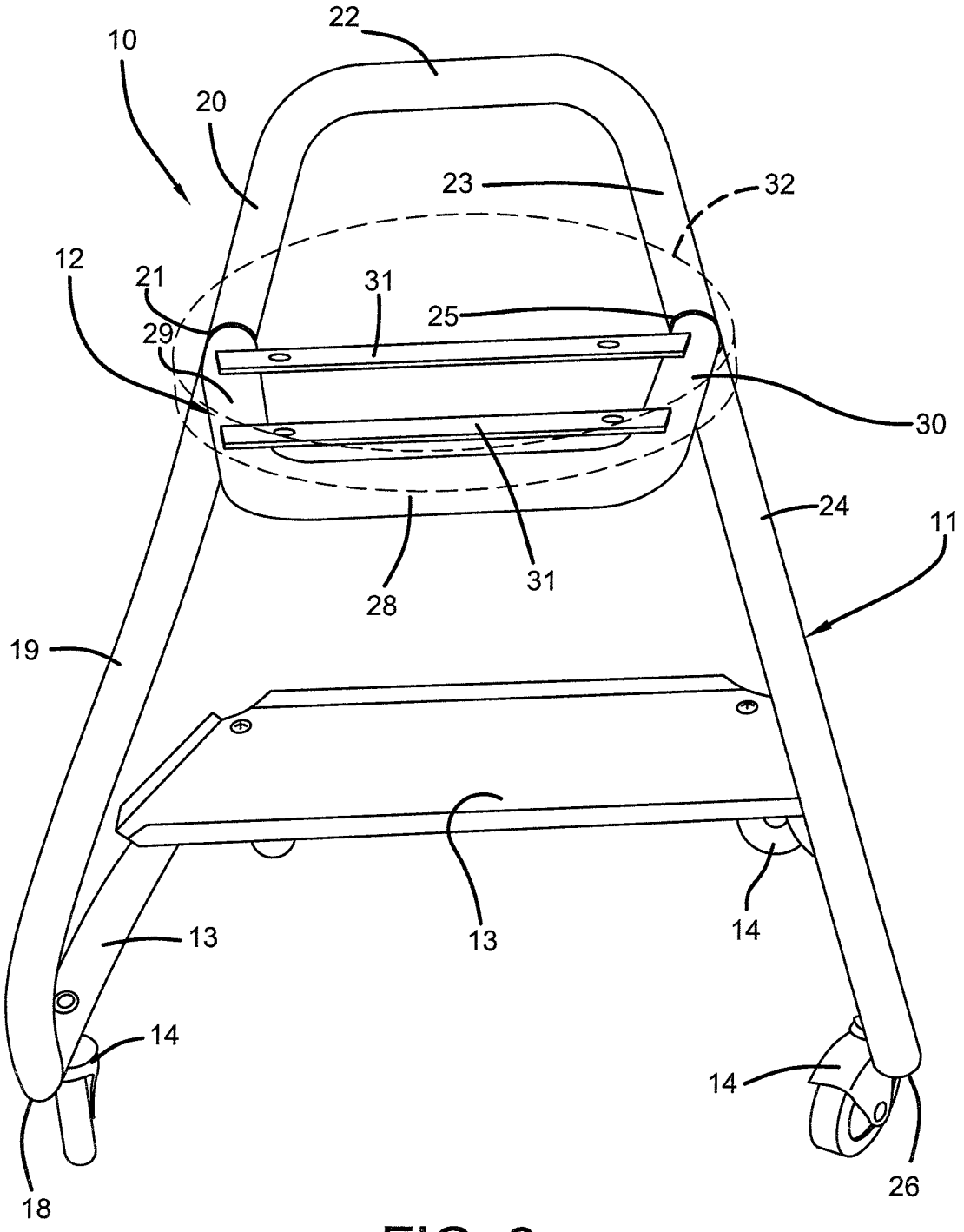
FIG. 2 is a front perspective view of the chair of FIG. 1 with the cushion attached.

Seat frame 12 is generally U-shaped in configuration having a base portion 28 and opposed branches 29 and 30. Branches 29 and 30 extend from base portion 28 and join with frame 11 at locations 21 and 25, respectively. One or more cross bars 31 can extend between branches 29 and 30 and are adapted to receive and hold a padded seat 32 (shown if FIG. 2) for chair 10.

It should thus be evident that a mobile chair constructed as described herein accomplishes the objects of the present invention and otherwise substantially improves the art.

What is claimed is:

1. A chair comprising a one piece main frame, and a seat frame attached to said main frame, said main frame having spaced sides with no portion of said frame being located between said sides below said seat frame, said main frame including generally horizontal spaced base portions, diagonally upwardly spaced side supports, a back support extending upwardly at an angle different from said side supports, and strength bends between each said base portion and each said side support such that said strength bends angle said side supports diagonally over said base portions towards a rear of said chair, and such that said side supports are supported by said strength bends at the front of the chair and extend to said back support at the rear of the chair.

2. The chair of claim 1 further comprising a plurality of caster assemblies carried by said base portions.

3. The chair of claim 1 further comprising a tray carried between portions of said base portions so that the space below said seat frame remains unobstructed.

4. The chair of claim 1 wherein said base portions, said side supports, and said back support are formed of one continuous tubing.

5. The chair of claim 1 wherein said seat frame extends outwardly from said main frame at generally the junction of said back support and said side supports.

6. A chair comprising a single continuous tubular frame having free ends located near the back of the chair, said tubular frame having spaced base portions extending from said ends toward the front of the chair, space between two side supports at the front of the chair being unobstructed, strength bends located between each said base portion and each said side support, and a seat frame attached to said tubular frame above the unobstructed space and above the two side supports that extend upwardly and rearwardly from the front of the chair to the back of the chair.

7. The chair of claim 6 wherein said tubular frame includes a back support extending upwardly from said side supports.

8. The chair of claim 7 wherein said back support is U-shaped thereby connecting said side supports to form said continuous tubular frame.

9. The chair of claim 7 wherein said seat frame extends outwardly from said tubular frame at generally the junction of said back support and said side supports.

10. A chair comprising a single continuous tubular frame having free ends located near the back of the chair, said frame having spaced base portions extending from said ends toward the front of the chair, space between said base portions at the front of the chair being unobstructed, and a tray located adjacent the back of the chair carried between said base portions near said free ends of said frame and extending partially toward the front of the chair so as to maintain the space between said base portions at the front of the chair unobstructed, and wherein said frame includes spaced side supports extending upwardly and rearwardly from the front of said base portions to the back of the chair.

11. The chair of claim 10 said tubular frame further including strength bends between each said base portion and each said side support.

12. The chair of claim 10 wherein said tubular frame includes a back support extending upwardly from said side supports.

13. The chair of claim 12 wherein said back support is U-shaped thereby connecting said side supports to form said continuous tubular frame.

14. The chair of claim 12 wherein said seat frame extends outwardly from said main frame at generally the junction of said base support and said side supports.

* * * * *